US005824201A

United States Patent [19]

Fabian et al.

[11] Patent Number: 5,824,201

[45] Date of Patent: Oct. 20, 1998

[54] ELECTRODE FOR USE IN MEMBRANE ELECTROLYZERS

[75] Inventors: Peter Fabian, Hanau, Germany; Emilio Zioni, Trezzano, Italy

[73] Assignee: De Nora S.p.A., Italy

[21] Appl. No.: 960,568

[22] Filed: Oct. 30, 1997

Related U.S. Application Data

[63] Continuation of Ser. No. 743,108, Nov. 4, 1996, Pat. No. 5,770,024.

[30] Foreign Application Priority Data

Nov. 22, 1995 [IT] Italy ..... MI95A2421

[51] Int. Cl.[6] ..... C25B 11/00

[52] U.S. Cl. ..... 204/284; 204/286; 204/288; 204/290 R; 204/292

[58] Field of Search ..... 204/284, 286, 204/288, 290 R, 292

[56] References Cited

U.S. PATENT DOCUMENTS 4,923,583 5/1990 Woodard, Jr. et al. ..... 204/286
5,660,698 8/1997 Scannell et al. ..... 204/288

*Primary Examiner*—Bruce F. Bell
*Attorney, Agent, or Firm*—Bierman, Muserlian and Lucas

[57] ABSTRACT

The invention concerns an improved electrode particularly useful for electrochemical processes forming gaseous products. The electrode is made of a composite structure comprising a shaped sheet having a profile of the "venetian blind" type, which provides for ensuring the necessary stiffness and improved local fluodynamics, and a mesh having the same "venetian blind" profile, provided with an electrocatalytic coating. The mesh is fixed by spot welding to the sheet in order to have the two profiles substantially coincident.

7 Claims, 3 Drawing Sheets

ELECTRODE FOR USE IN MEMBRANE ELECTROLYZERS

PRIOR APPLICATION

This application is a continuation of U.S. patent application Ser. No. 743,108 filed Nov. 4, 1996, now U.S. Pat. No. 5,770,024.

The ion-exchange membrane electrolysis process is presently the preferred method for the industrial production of chlorine and caustic soda from brine, that is from an aqueous concentrated solution of sodium chloride, although promising opportunities may be devised also for other industrial applications such as the production of hydrogen and oxygen by electrolysis of alkali metal hydroxide solutions. However, in view of the current outstanding preeminence of chlor-akali electrolysis, the following description will make reference to this process without any intention of limiting the invention thereto. The chlor-alkali electrolysis process is characterized by a smooth operation in the long term provided that certain technical aspects are adequately addressed. Two of these aspects are represented by the reciprocal interaction between the electrodes and the ion-exchange membranes and by the operating lifetime of the electrodes, As concerns the first of these aspects, it must be taken into account that the turbulence of the electrolytes may easily cause fluttering of the delicate ion-exchange membrane. To avoid such a problem, which would readily cause ruptures of the membrane, usually the two compartments of each elementary cell, which form an industrial electrolyzer, are characterized by a pressure differential which actually maintains the membrane pressed against one the electrodes, normally the anode in membrane chlor-alkali electrolysis. The other electrode may also be pressed against the membrane by means of suitable resilient systems, thus increasing the mechanical stability of the membrane itself (this technology is known as "zero-gap"). Alternatively, the other electrode may be spaced apart from the membrane which is pushed against the first electrode by the pressure differential, as already said (technology known as "finite-gap" or "narrow-gap").

In any case the membrane is in contact with at least one electrode, the geometry of which is extremely important. Various electrode geometries are known in the art, from the so-called expanded metal to plates cut into parallel strips provided with edged profiles which act as gas-diverting means (see European Publication No. 0 102 099), to the "venetian blind" electrodes (see European Publication No. 0 189 535), obtained by cutting metal sheets with suitable tools.

To obtain the best performance of the membrane it is important that the portions of the electrode made of solid metal have dimensions as reduced as possible as the diffusion of sodium chloride brine inside the interstices between the membrane and the metal is slowed down and as a consequence, the liquid inside the interstices is progressively diluted. The dilution of the brine leads to blistering of the membrane. Another deterioration mechanism derives from the stagnation of chlorine pockets inside the membrane/metal interstices. This stagnation causes the formation of sodium chloride crystals inside the membrane, the structure of which becomes permanently altered thus spoiling its performances (see Modern Chlor-Alkali Technology, Vol. 4, Elsevier Applied Science, 1990, pages 109–123). These phenomena of membrane damaging are more easily controlled with expanded metal electrodes wherein the dimensions of the mesh openings and of the solid metal portions may be largely varied by suitably adapting various parameters such as the pitch between cuts and their length, as well as the expansion degree. The situation is much more critical with other geometries, in particular with "venetian blind" electrodes which, on the other hand, offer remarkable advantages as regards local fluodynamics of the gas-liquid mixtures of the electrolysis products (see European publication No. 0 189 535). In fact, with the "venetian blind" electrodes, there are large areas of contact between the membrane and the solid metal portions of the electrodes and therefore there is a high risk of damages as aforementioned, the more probable the higher is the current density during operation in industrial electrolyzers.

To overcome the problem of membrane damaging, various solutions have been suggested such as the roughening of the membrane surface to be contacted with the electrode. This roughening may be obtained through a partial corrosion of the surface, for example by a plasma beam or by applying a layer of hydrophilic powder which hinders the adhesion of gas bubbles. Alternatively the electrode surface may be roughened by engraving it with holes and channels in a herring-bone pattern, made by a laser equipment (see U.S. Pat. No. 5,114,547).

As concerns the second aspect, that is the operating lifetime of the electrodes, this depends on the structure of the electrodes which comprises a metal substrate having the aforementioned geometries, provided with an electrocatalytic coating. For example, when the electrodes act as anodes (positive polarity), the substrate is titanium and the coating is made of oxides of the platinum group metals having a thickness of some microns. When the electrodes act as cathodes (negative polarity), the substrate is nickel or carbon steel or stainless steel coated by a thin film (some microns) of Raney nickel, platinum group metals or oxides of the same, alone or in combination. The lifetime of these electrocatalytic coatings depends on the operating conditions, in particular temperature, current density, electrolyte concentration and presence of poisoning agents capable of hindering the electrocatalytic activity ("poisoning"). In any case, after a certain period of operation, the electrodes must be renewed (in the following description: reactivation). The simplest way is shipping the structures where the electrodes are fixed to the producer's facilities where the electrodes are detached from the supporting structures and substituted with new electrodes. Obviously this operation is time-consuming (shipping, mechanical operations) and expensive (total renewal of the electrodes including the metal substrate). A possible alternative consists in fixing, usually by spot-welding, a new electrode onto the surface of the exhausted one. For this purpose, thin nets are used which have suitable dimensions of the openings and above all a small thickness (see European publication No. 0 044 035). This method has the substantial inconvenience of altering the local geometry of the membrane-electrode contact, thus modifying to a great extent the fluodynamics of the mixtures of electrolyte and produced gas. This inconvenience is of particular concern when the thin activated net is applied to exhausted electrodes of the "venetian blind" type or similar geometry.

It is therefore evident that the solutions proposed by the prior art (e.g. roughening of the membrane or electrode surface) have only reduced the impact of the width of the membrane-electrode contact, remarkably adding to the production costs (e.g. use of laser equipment) or have solved a problem (reactivation of exhausted electrodes using thin activated nets) giving rise to additional inconveniences (worse local fluodynamics of the gas-electrolyte mixtures).

OBJECTS OF THE INVENTION

It is the object of the present invention to provide for a new electrode capable of completely overcoming the problems affecting the prior art, particularly concerning the geometry of the contact area between the membrane and electrodes of the "venetian blinds" type or similar geometries, when the electrodes become exhausted after a period of operation. As concerns this last aspect, the electrode of the present invention has a structure whereby the reactivation may be effected at plant site without shipping the exhausted electrode systems to the producer facilities.

It is a further object of the present invention to provide for a new electrode structure provided with an electrocatalytic coating which strongly decreases the problems associated with the membrane-electrode contact and further permits easy reactivation of the coating when it become exhausted.

DESCRIPTION OF THE INVENTION

Figure 3:
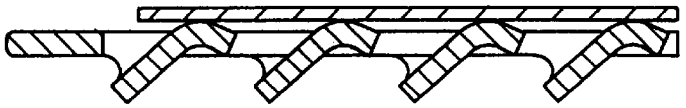
FIG. 3 PRIOR ART
FIG. 3 shows a composite structure comprising the electrode of FIG. 1 provided with an activated planar sheet used to renew the electrode electrocatalytic activity according to the teachings of the prior art.

A preferred embodiment of the present invention is illustrated in FIGS. 4, 5, 6 and 7. The mesh provided with an electrocatalytic coating fixed to the electrode of FIG. 1, known in the art, ensures several advantages which will be explained in the following description. First of all, the mesh, characterized by a lower thickness than that of the electrode, perfectly adheres to the electrode sheet profile, and may be efficiently fixed thereto by spot-welding. The solution proposed by the prior art and illustrated in FIG. 3 is negatively affected by several problems concerning welding, probably due to the small contact area between the planar sheet and the bent profiles of the electrode of the "venetian blind" type. Therefore the welding procedure known in the art is scarcely reliable and detachments are possible with the consequent uneven distribution of current. In addition to the possibility of resorting to an easier and more reliable welding procedure, the preferred embodiment of the present invention maintains all the advantageous fluodynamics characteristics of the prior art electrode of FIG. 1.

Figure 2:
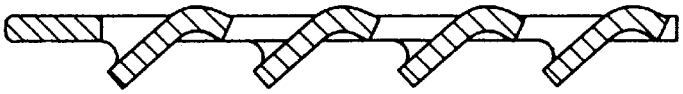
FIG. 2 PRIOR ART
FIG. 2 is a cross-section of the electrode structure of FIG. 1. The electrode is obtained from a metal sheet shaped with a special tool which at the same time cuts strips in the sheet and bends them.
Figure 1:
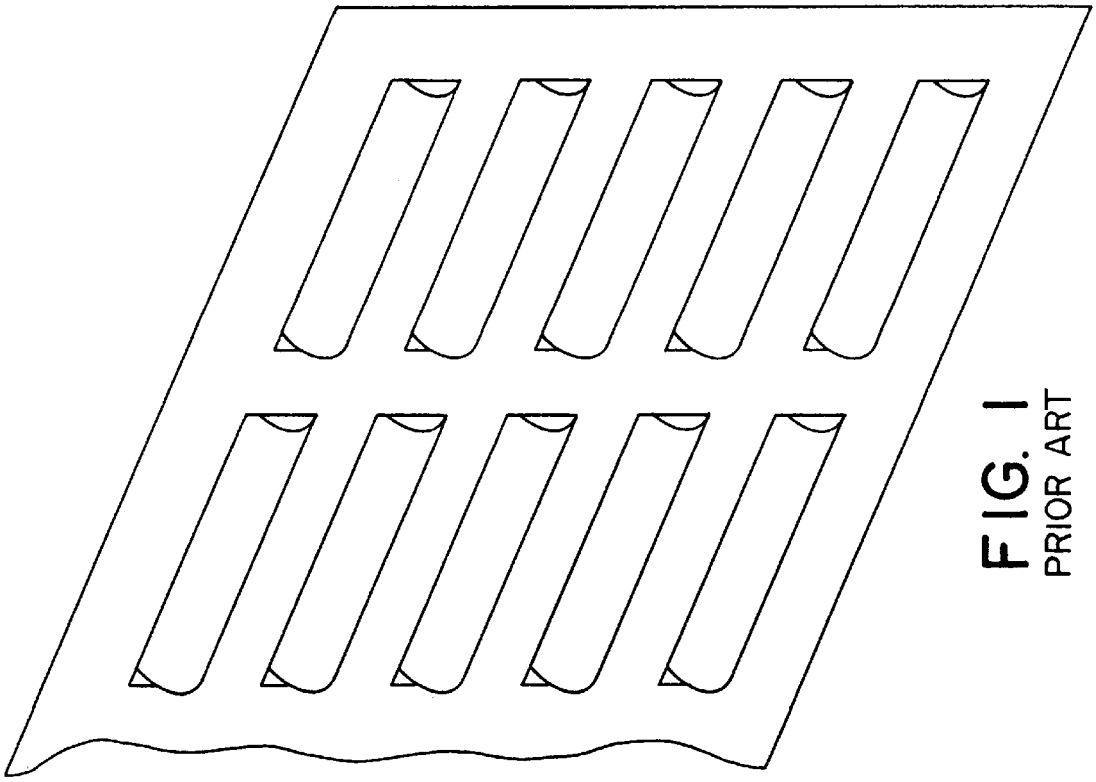
FIG. 1 PRIOR ART
FIG. 1 is a front view of an electrode of the "venetian blind" type.
Figure 5:
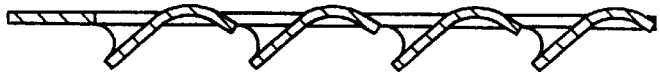
FIG. 5 shows the profile of the shaped mesh of FIG. 4.
Figure 4:
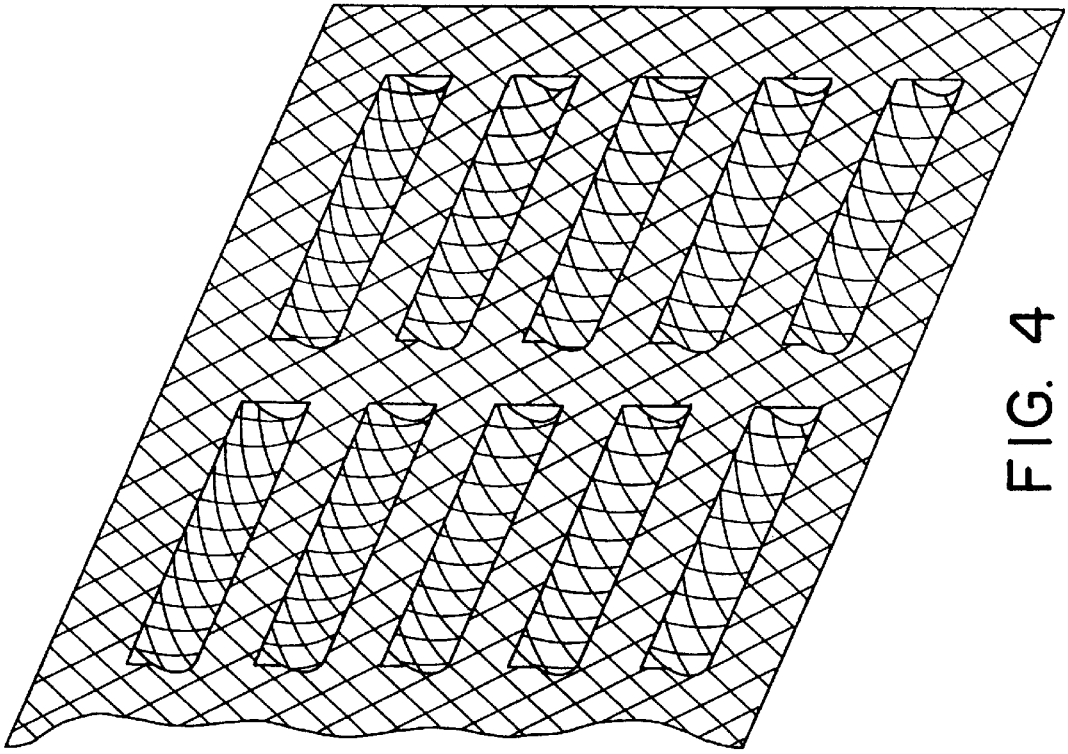
FIG. 4 is a front view of the preferred embodiment of the present invention. A planar mesh made of the same metal as the sheet and previously provided with an electrocatalytic coating is shaped using the same tool used for the electrode of FIG. 1. The shaped mesh therefore has the same profile as the sheet electrode as shown in FIG. 5
Figure 7:
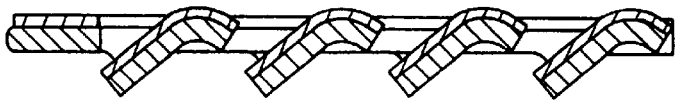
FIGS. 6 and 7 show the coincident profiles of the shaped mesh of FIGS. 4 and 5 applied to the sheet of FIGS. 1 and 2.
Figure 6:
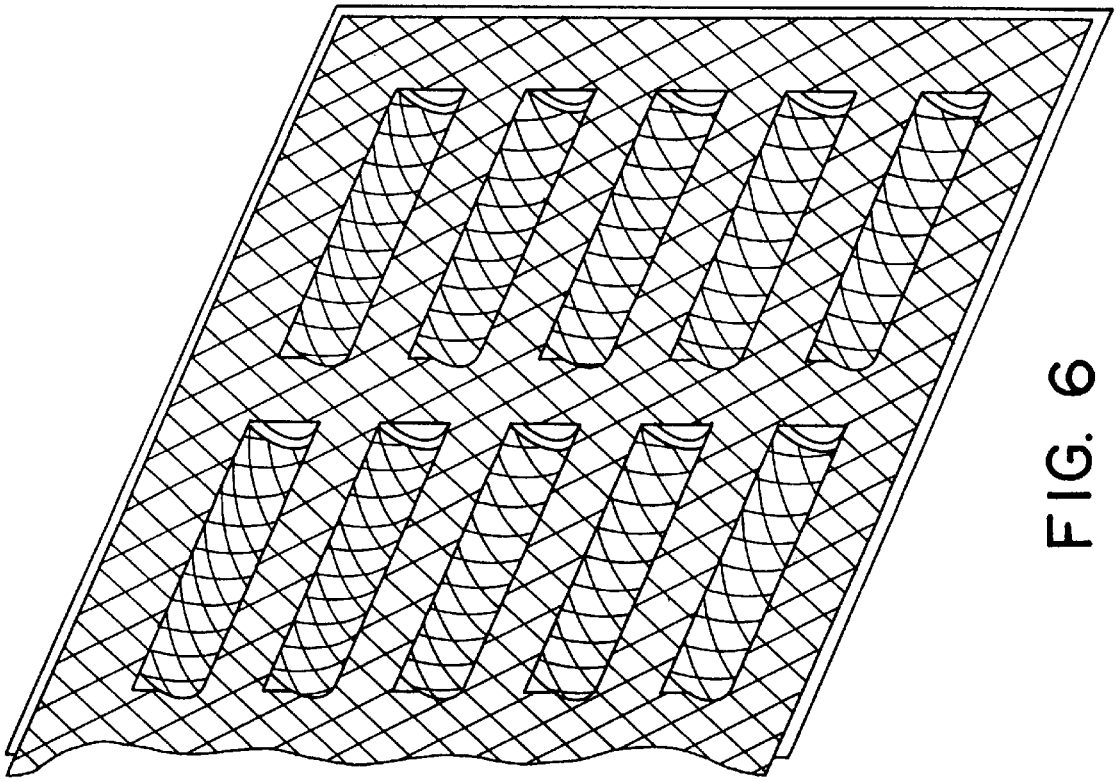

As a further advantage, the present invention provides for an electrode, the bent profiles of which have an irregular profile particularly useful for preventing the membrane from sticking to the metal and thus avoiding the negative phenomena of dilution of the sodium chloride solution and gas entrapping. This result is obtained in an efficient way, at low cost and with an easy construction method, in particular when the dimensions of the mesh openings are lower than the width of the strips of the "venetian blind" electrode. Preferably the mesh is obtained by expansion of a sheet having a suitable thickness. As a consequence, the preferred embodiment of the invention sums up all the advantages offered by different prior art inventions, that is reactivation using a planar sheet and elimination of the problem of dilution in the interstices and gas entrapping by engraving the electrode surface with channels in a herring-bone pattern. Furthermore, these advantages are joined in a single element, easy to be produced with low costs, capable of maintaining the fluodynamics characteristics of the structures of the prior art. For this reason the preferred embodiment of the present invention is useful not only for the reactivation of exhausted electrodes but also for installation in new electrolyzers. In this case the production procedure foresees the following steps:

- shaping of a metal sheet to obtain the structure and profile of FIGS. 1 and 2. Contrary to the teachings of the prior art, this structure is not provided with an electrocatalytic coating;
- expansion of a thin sheet to form the mesh characterized by suitable dimensions of the mesh openings and by lower thickness with respect to the shaped sheet. The mesh is provided with a suitable electrocatalytic coating. The mesh is then shaped with the same tool used to shape the metal sheet. A shaped mesh is thus obtained which perfectly adapts to the shaped sheet. In this way the sheet-mesh assembly may be more easily welded and the reliability of the welding is enhanced.

As a conclusion, in the composite structure of the present invention, the two components have different and complementary functions. In particular, the shaped mesh, having a sufficient thickness, ensures the necessary rigidity to the electrode assembly and with its profile provides for the best local fluodynamics. The mesh has the main function of providing the assembly with the necessary electrocatalytic activity and the necessary surface roughness to prevent damaging of the membrane caused by dilution in too small interstices and gas entrapping, as mentioned before. In another less preferred embodiment of the present invention, a thin sheet is used instead of the mesh. In this case the sheet is provided with a suitable electrocatalytic coating and is then shaped with the same tool used to shape the thicker sheet. In this way, the thin sheet, provided with the electrocatalytic coating, perfectly adheres to the profile of the thicker shaped sheet. Obviously the use of the sheet may be resorted to only in the case of reactivation of exhausted electrodes. However, the use of the thin sheet involves higher costs than the thin mesh and the electrode assembly profile is smooth. Therefore, in the absence of the necessary roughness, the membrane may be damaged, as it happens with the prior art electrodes of FIG. 1. Conversely, likewise the thin mesh, welding of the thin sheet, previously shaped as aforesaid, is easy and reliable. Further, also with the thin sheet the local fluodynamics typical of the original electrode are maintained. The above discussion clearly illustrates the distinctive features of the present invention and some preferred embodiments of the same. However, further modifications are possible without departing from the scope of the invention, which is limited only by the following appended claims.

We claim:

1. An electrode for electrochemical processes forming gaseous products comprising a metal sheet shaped to produce a louvered profile comprising bent metal strips and attached thereto is a thin metal sheet having a thickness which ensures rigidity to the electrode and which is provided with an electrocatalytic coating having the same louvered profile as that of the metal sheet wherein the profiles of the thin metal sheet and metal sheet are coincident.

2. An electrode of claim 1 wherein the thin metal sheet is attached to the metal sheet by welding.

3. An electrode of claim 2 wherein the welding is electrical resistance spot-welding.

4. The electrode of claim 1 wherein the metal sheet has an exhausted electrocatalytic coating thereon.

5. An electrode of claim 1 wherein the metal sheet is devoid of any coating.

6. An electrode of claim 1 capable of functioning as a cathode wherein the metal sheet and the thin metal sheet are made of nickel and the thin metal sheet is provided with an electrocatalytic coating for hydrogen evolution in an alkali metal chloride electrolysis.

7. An electrode of claim 1 capable of functioning as an anode wherein the metal sheet and the thin metal sheet are made of titanium and the thin metal sheet is provided with an electrocatalytic coating f or chlorine evolution in an alkali metal chloride electrolysis.

* * * * *